United States Patent [19]

Misulovin et al.

[11] 3,944,956

[45] Mar. 16, 1976

[54] MAGNETICALLY CONTROLLED SWITCHING MATRIX

[75] Inventors: Leonid Yakovlevich Misulovin, Riga; Igor Ivanovich Panin, Ogre, Latviiskoi; Yakov Girshevich Soloveichik, Riga; Leonid Anisimovich Kovalev, Riga; Viktor Olimpievich Zhoglo, Riga, all of U.S.S.R.

[73] Assignee: Corning Glass Works, Corning, N.Y.

[22] Filed: July 31, 1974

[21] Appl. No.: 493,731

[52] U.S. Cl. ..... 335/112; 335/152; 340/166 S

[51] Int. Cl.[2] ..... H01H 67/14

[58] Field of Search ..... 335/111, 112, 134, 152; 340/166 S

[56] References Cited

UNITED STATES PATENTS 3,431,519 3/1969 Giichi et al. ..... 335/112

*Primary Examiner*—G. Harris

*Attorney, Agent, or Firm*—Clinton S. Janes, Jr.; Clarence R. Patty, Jr.

[57] ABSTRACT

A magnetically controlled switching matrix is composed of magnetic members each having two coils placed thereon and connected into respective row and column energizing circuits, and comprises a generator of decaying alternating current pulses electrically coupled with the row coils, and a direct current generator electrically coupled with columns coils.

7 Claims, 10 Drawing Figures

MAGNETICALLY CONTROLLED SWITCHING MATRIX

The invention relates to switching devices and more particularly to a magnetically controlled switching matrix which can be employed for switching voice channel circuits and discrete information transmission channels in automatic exchanges.

DESCRIPTION OF THE PRIOR ART

Known in the prior art are magnetically controlled switching matrices which have magnetic members at the junctions of the matrix coordinates and which are operated by driving signals applied to these coordinates. Such known switching matrices make it possible to select among *mn* magnetic members by applying short signals to only *m+n* control conductors.

The known magnetically controlled switching matrices comprise magnetic members arranged to form matrix rows and columns which are made from a magnetic material with at least two stable magnetization states, each of these magnetic members having two coils thereon, one of which is connected into the electric circuit of the matrix row corresponding to the magnetic member and the second of which is connected into the electric circuit of the column corresponding to the magnetic member, each magnetic member being magnetically coupled with at least one respective magnetically responsive switch, all coils of each row being electrically connected to an output of a first current source through a row selection circuit, while all coils of each column are electrically connected to an output of a second current source through a column selection circuit.

One of the known switching matrices consists of four coils wound on two separate magnetic members of a particular magnetically responsive switch with two coils on each member. One coil of each member has a number of turns sufficient to drive its associated magnetic member to saturation when driving current signals are applied, while the other coil has twice the number of turns of the former coil. One coil of a second member consists of a number of turns sufficient to drive its associated magnetic member to saturation, and the other coil has twice the number of turns of the former coil. The coils of the two members are interconnected so that energization of each separate coil establishes conditions for magnetization of the two magnetic members with opposite polarities and causes the associated switch to open if it has previously been closed. If concurrent signals are applied to both windings, the magnetic flux in the magnetic member adds and the respective magnetically responsive switches close (cf. U.S. Pat. No. 3,037,085; Cl. 335–159).

A disadvantage of this known magnetically controlled switching matrix lies in that such an arrangement of coils on the magnetic members makes it imperative to have these members exactly identical which places high requirements on the manufacturing technology and renders the latter expensive and inefficient. Besides, the technology of matrix manufacturing is complicated due to the necessity of winding composite coils individually for each magnetic member which is also expensive and uneconomical.

Another disadvantage of this known magnetically controlled switching matrix is that a driving pulse applied to the winding causes a brief closure of the magnetically responsive switches in all the magnetic members of selected rows and columns in which the magnetomotive force of the magnetically responsive switches is less than the differential magnetomotive force during a driving pulse. This impedes the utilization of the matrix for switching discrete information channels and, further, reduces the life of the magnetically responsive switch.

Yet another disadvantage of the known magnetically controlled matrix is its large size which cannot be reduced.

Still another disadvantage of the known switching matrix is that the selection of a particular magnetic member releases all magnetically responsive switches both in the selected row and in the selected column which cannot be considered optimun because to simplify the control system of the matrix it is required that all the previously closed magnetically responsive switches be opened along a selected row or column coordinate only.

Another switching matrix known in the art is a magnetically controlled switching matrix which comprises generators of decaying alternating current pulses as current sources, a signal from one of the current sources being initiated one-half cycle after the other (cf. U.S. Pat. No. 3,488,435; Cl. 340–166).

Though somewhat simplifying the design of the matrix, such a solution, however, has not eliminated the disadvantages of the matrix known in the prior art. On the contrary, in such a matrix there is a higher probability of a brief closure of the magnetically responsive switches and control power requirements are increased.

SUMMARY OF THE INVENTION

It is an object of this invention to provide a magnetically controlled switching matrix of simple design and small dimensions.

Another object of this invention is to provide a switching matrix in which there are no brief closures of the magnetically responsive switches.

A further object of this invention is to provide a switching matrix of a design that minimizes matrix control complexity and reduces control power requirements.

The foregoing and other objects of the invention are realized in a specific embodiment thereof which comprises magnetic elements arranged in rows where are columns and made from a magnetic material with at least two stable magnetization states each of which has two coils thereon, one coil connected into its row energizing circuit, and the other connected into its column energizing circuit, each magnetic member being magnetically coupled with at least one respective magnetically responsive switch, all coils of the row being electrically connected to an output of a first current source through a row selection circuit, and all coils of the columns being electrically connected to an output of a second current source through a column selection circuit, and in which, according to the invention, the first current source is a generator of decaying alternating current pulses, and the second current source is a direct current generator, the selected row and column coils acting upon a respective magnetic member by decaying alternating and permanent magnetic fields concurrently thereby magnetizing this magnetic member in a pattern described by a hysteresis-free magnetization curve.

It is advantageous that the coils are wound on the magnetic member such that the magnetic fluxes induced thereby are coaxial.

It is also sometimes advantageous that the coils are wound on the magnetic element such that the induced magnetic fluxes are orthogonal.

It is preferable that the switching matrix comprises closed loops wound around the magnetically responsive switches and made from a non-magnetic possessing an electric conductance sufficient to protect the magnetically responsive switches from the effect of a decaying alternating magnetic field.

If each magnetic member is magnetically coupled with one magnetically responsive switch, it is further preferable that a closed turn be placed on this switch.

If each magnetic member is magnetically coupled with at least two magnetically responsive switches, it is advisable that a closed loop be placed upon these switches.

It is also advisable that the magnetic axes of all the magnetically responsive switches run coaxially with the matrix columns.

BRIEF DESCRIPTION OF THE DRAWINGS

The foregoing and other objects and features of this invention will be better understood from a consideration of the detailed description of specific embodiments thereof when read with the accompanying drawings in which.

DETAILED DESCRIPTION OF THE PREFERRED EMBODIMENTS

Consider a preferred embodiment magnetically controlled switching matrix.

Each magnetic member 1 (FIG. I) of the switching matrix has two coils 2 and 3 wound thereon and is magnetically coupled with a magnetically responsive switch 4. The magnetic member 1 is made of a magnetic material exhibiting at least two stable states of magnetic remanence with rectangular hysteresis characteristics. The magnetically responsive switch 4 may be either hermetically sealed or unsealed.

Figure 1:
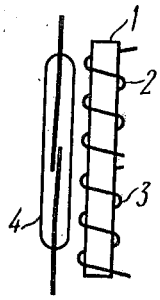
FIG. 1 shows a magnetically responsive switch of a switching matrix with its associated magnetic member and coils adapted for the practice of this invention.
Figure 2:
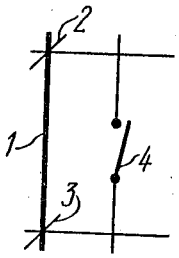
FIG. 2 is a schematic representation of a magnetically responsive switch of a switching matrix with its associated magnetic member and coils adapted for the practice of this invention.

FIG. 2 is a schematic representation of magnetically responsive switch 4 and its associated magnetic member 1 with the coils 2 and 3.

All magnetic members 1 (FIG. 3) are arranged in rows $x_1, x_2, x \ldots x_n$ and columns $y_1, y_2, \ldots y_m$ of a switching matrix.

The coils 2 of the magnetic members 1 are connected in an $x$ row energizing conductor and the coils 3 are connected in a $y$ column energizing conductor of a control array.

Buses 5 of rows $x$ and buses 6 of columns $y$ connect the magnetically responsive switches 4 to form a switching matrix.

The electric circuit of each row $x$ formed by the coils 2 is closed through a conventional row selection circuit 7 and through a generator 8 of decaying alternating current. This generator 8 is a conventional multivibrator circuit having an individual limited-power source. The generator 8 may also be a known current generator with a shock excitation oscillating circuit.

The electric circuit of each column $y$ formed by the coils 3 is closed through a conventional column selection circuit 9 and a D.C. generator 10.

Figure 4:
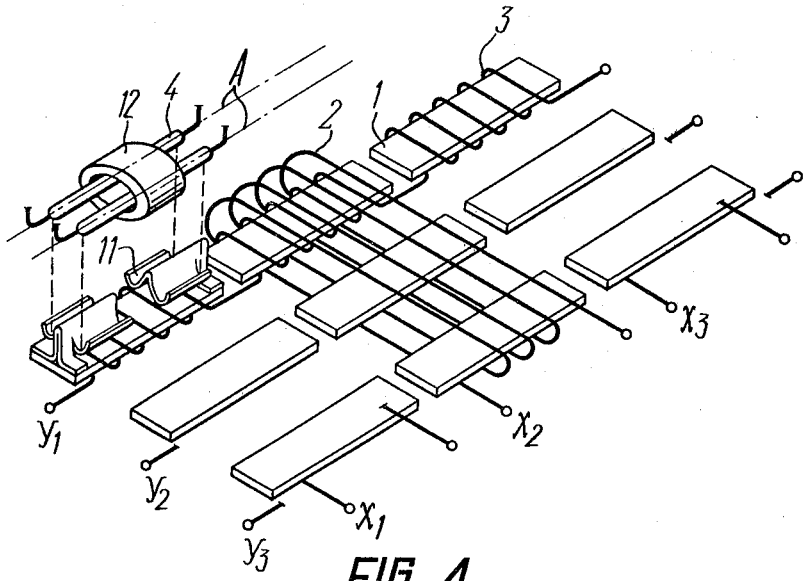
FIG. 4 is a structural diagram of one embodiment of a magnetically controlled switching matrix of this invention.

FIG. 4 shows one structural embodiment of a magnetically controlled switching matrix.

All magnetically responsive switches 4 are disposed with respect to the magnetic member 1 such that their magnetic axes A are parallel to matrix columns $y$.

The magnetic member 1, pole tips 11 and the associated magnetically responsive switches 4 form a closed magnetic circuit, two magnetically responsive switches 4 having a closed loop 12 thereon which is made of a non-magnetic material exhibiting electric conductance sufficient to protect these switches 4 from the effect of a decaying alternating magnetic field. The closed loop 12 can be made, for example from copper or aluminium.

Figure 5:
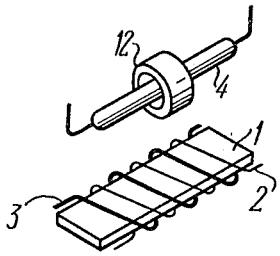
FIG. 5 shows a magnetically responsive switch of a switching matrix with a closed loop placed thereon and an associated magnetic member with coils according to the principles of this invention.

When the magnetic member 1 is coupled with only one magnetically responsive switch 4 (FIG. 5), it has an individual turn 12 placed thereon.

In the structural diagram shown in FIG. 4, the coils 2 and 3 are disposed relative to their associated magnetic member 1 such that the magnetic fluxes they induce are coaxial.

Figure 6:
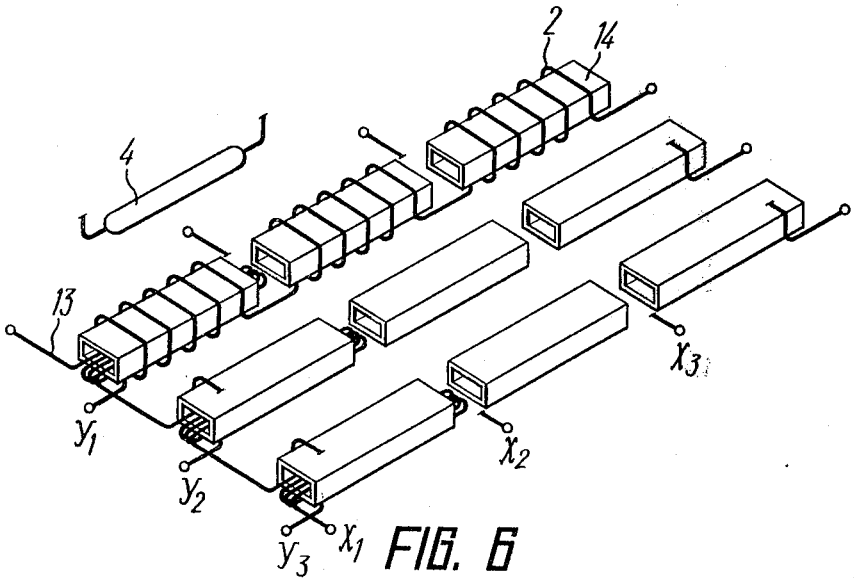
FIG. 6 is a structural diagram of another embodiment of a magnetically controlled switching matrix of this invention.

In the structural diagram of a switching matrix represented in FIG. 6, the coils 2 and 13 are wound on each magnetic member 1 such that they induce orthogonal magnetic fluxes. In this case, there is no need for placing the closed loops 12 (FIG. 4) on the magnetically responsive switches 4 (FIG. 6), and the shape of each magnetic member 14 is such as to provide a closure path for the magnetic flux induced by the coil 2.

Figure 7:
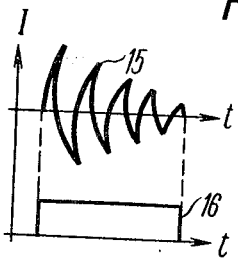
FIG. 7 represents current pulses produced by generators of D.C. and decaying alternating currents, in accordance with this invention.

FIG. 7 shows the waveforms of decaying alternating current pulses 15 and a direct current pulse 16 generated, respectively, by the generators 8 and 10. Here, the ordinate represents current I, and the abscissa represents time t.

Figure 8:
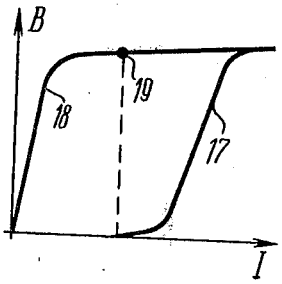
FIG. 8 is a graph showing magnetic induction versus current for different types of magnetization conditions.

FIG. 8 shows a graph of magnetic induction B (ordinate) versus current I (abscissa) for hysteresis magnetization of the magnetic member 1 (curve 17), and the same relationship for hysteresis-free magnetization of the magnetic member 1 (curve 18).

Figure 9:
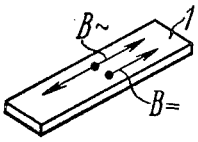
FIG. 9 shows the direction of magnetic induction vectors in a magnetic member of the first structural embodiment of this invention.

FIG. 9 is a schematic representation of the direction of magnetic induction vectors B= and B~ in the magnetic member 1 in the structural embodiment of the matrix of FIG. 4.

Figure 10:
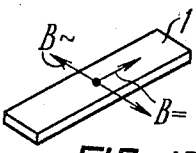
FIG. 10 shows the direction of magnetic induction vectors in a magnetic member of the second structural embodiment of this invention.

FIG. 10 is a schematic representation of the direction of magnetic induction vectors B= and B~ in the magnetic member 1 in the structural embodiment of the matrix shown in FIG. 6.

The magnetically controlled switching matrix of the present invention operates as follows.

On a command from an external current steering circuit, the row selection circuit 7 (FIG. 3) and the column selection circuit 9 connect the outputs of the current generators 8 and 10 to a selected row and column, respectively.

In response to the next command from the external current steering circuit, the generator 8 produces a control signal in the form of the decaying alternating current pulses 15 shown in FIG. 7, while the generator 10 (FIG. 3) produces the direct current pulse also shown in FIG. 7. The pulses 15 and 16 are mutually timed such that they act either concurrently (see FIG. 7), or the D.C. pulse 16 starts before and is terminated after the decaying alternating current pulses 15.

Figure 3:
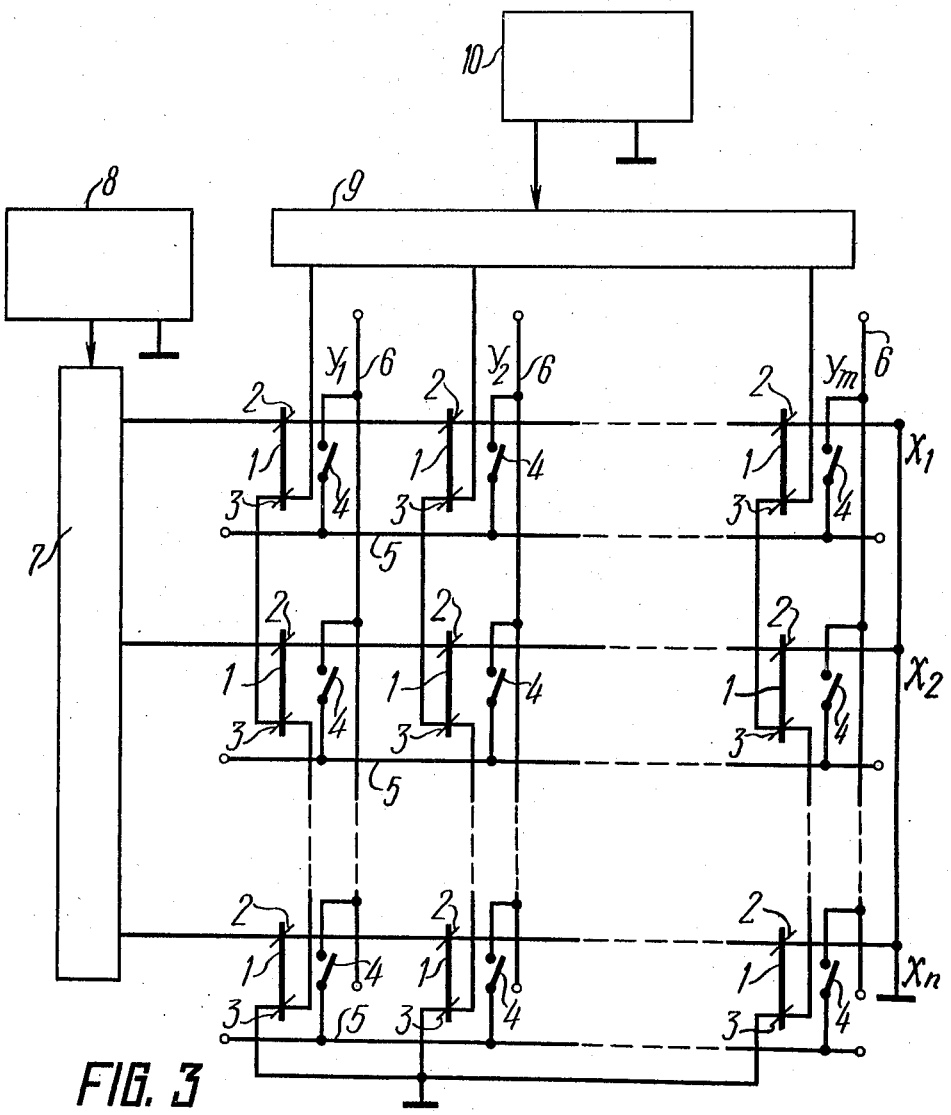
FIG. 3 is a schematic diagram of a magnetically controlled switching matrix according to the principles of this invention.

The pulses 16 applied to the coils 3 (FIG. 3) of the selected column magnetize all magnetic members 1 except the one magnetic member 1 at the junction of the selected row, the magnetization curve being as shown in FIG. 8 (curve 17). The amplitude of the pulse 16 (FIG. 7) is selected so as not to appreciably disturb the remanence of the magnetic member 1 (FIG. 3).

The decaying alternating current pulses 15 (FIG. 7) applied to the coils 2 (FIG. 3) of the selected row demagnetize all the magnetic members 1 (if they have been magnetized), except the magnetic member 1 at the junction of the selected column.

The amplitude of a first current pulse 15 (FIG. 7) from a train of the decaying alternating pulses 15 is selected so as to be able to drive the magnetic member 1 (FIG. I) to saturation.

The magnetic member 1 located at the junction of the selected row and column is acted upon by two magnetic fields - a small permanent magnetic field which alone cannot change the magnetization state of the magnetic member 1, and a decaying alternating magnetic field the first pulses of which reverse the polarity of this selected magnetic member 1. It is known that the action of the two magnetic fields mentioned above causes magnetization of the magnetic member 1 described by the hysteresis-free magnetization curve 18 (FIG. 8), and that remanence B in the magnetic member 1 (FIG. 3) reaches the level indicated by a point 19 (FIG. 8).

After the terminal of the current pulses 15 and 16 (FIG. 7) all the magnetic members 1 (FIG. 3) of the selected row, except the member 1 lying at the junction of the selected row and column, are demagnetized, and all the associated magnetically responsive switches 4 are released.

All the magnetic members 1 of the selected column, except the above element 1 lying at the junction of the selected column and row, do not change their previous state of magnetization; in other words, the magnetized magnetic members 1 remain magnetized, and their associated magnetically responsive switches 4 that have been closed, remain in this state, whereas the demagnetized magnetic members 1 remain demagnetized, and their associated magnetically responsive switches 4 that have been released remain in the released state.

Only the selected magnetic member 1 lying at the junction of the selected row and column will be magnetized regardless of its previous magnetization state, and its associated magnetically responsive switches 4 will be closed.

When the coils 2 and 3 are wound on the magnetic member in the way shown in FIG. 4, the magnetic induction vectors B= and B~ are parallel and all the magnetic members 1 of the selected row induce alternating magnetic fields which may be sufficient to cause short-time closure of the magnetically responsive switches 4 associated with these magnetic members 1.

However, the opposing magnetic flux set up in the magnetically responsive switches 4 (FIG. 4) by means of the closed loop 12 cancels the above mentioned alternating magnetic fluxes.

When the coils 2 and 3 are wound on the magnetic member in the way shown in FIG. 6, the magnetic induction vectors B= and B~ shown in FIG. 10 are orthogonal, and the alternating magnetic fluxes therefore do not affect the magnetically responsive switches 4 (FIG. 6).

The magnetic axes A (FIG. 4) of all the magnetically responsive switches 4 and, consequently, the longitudinal magnetic axes of all the magnetic members are parallel to the matrix columns, and, therefore, the adjacent magnetic members 1 of the same row share the windings of this row.

In the course of operation, the maximum magnetic interaction arises between the row-adjacent magnetic members 1 the magnetic axes of which are parallel;

As one of the magnetic members 1 is being magnetized, its adjacent magnetic members 1 in a given row develop a small magnetic flux of an opposite polarity described by a hysteresis-free magnetization curve. The magnitude of this opposite-polarity magnetization depends on the distance between the adjacent magnetic members 1 in this row. The magnitude of the direct magnetic effect of the adjacent members 1 on the magnetically responsive switches 4 also depends on the distance between these row-adjacent magnetic members 1.

Thus, with a decrease of the distance between the row-adjacent magnetic members 1, the magnetically responsive switches 4 connected with these adjacent magnetic members 1 are affected by two opposing magnetic fluxes. The shorter the distance between the row-adjacent magnetic members 1, the larger the magnitude of these fluxes, but their difference acting upon the magnetically responsive switches 4 remains at a low level. Therefore, in the switching matrix of this structure the distance between the magnetic members of one row does not depend on the critical interaction, but is determined only by technological limitations.

The proposed magnetically controlled switching matrix can be used for example for switching two- and four-wire voice routes in the switching fields of telephone exchanges, for connecting exchange interaction signals in signal switching equipment, and also as cut-off relays in subscriber's line equipment.

Further, since such a structure of the matrix guarantees the absence of even brief closure of the magnetically resposive switches 4 in the selected row and column (except the selected magnetically responsive switch 4), it is possible to use this matrix for switching discrete information.

The proposed switching matrix embodiment in which each magnetic member 1 is magnetically connected with only one magnetically responsive switch 4 can be employed for switching signals from the transmitters of checking or diagnostic devices.

Due to the fact that magnetization of the magnetic members 1 follows a hysteresis-free magnetization curve, the permissible scatter of the magnetomotive operation forces and the restoration factor of the magnetically responsive switches 4 can be selected sufficiently large because the magnetomotive force of the demagnetized magnetic member 1 can reach a requisite low value by selecting the waveform and symmetry of the decaying alternating pulses 15 (FIG. 7), and the magnetomotive force of the magnetized magnetic member 1 (FIG. 4) can attain a requisite high value through selecting the coercive force of the material and the cross-section of the magnetic member 1 within permissible control power limits.

Another advantage of the proposed switching matrix is that the permissible scatter of the amplitudes of the decaying alternating current pulses 15 (FIG. 7) and the direct current pulses 16 can also be selected within sufficiently wide limits.

It will also be appreciated that the proposed switching matrix has a considerably smaller size which has become possible through shortening the distance between the magnetic members 1 (FIG. 4) due to compensation of the effect of the adjacent magnetic members 1 in one row on the magnetically responsive switches 4.

It should also be noted that since the proposed switching matrix has the ability to leave the magnetization state of the magnetic members 1 along the column undistrubed when driving signals are applied, it is possible to form switching macroarrays composed of column-connected switching matrices which permits reduction in the number of the switches and facilitation of control.

We wish it to be understood that we do not desire to be limited to the exact details of construction shown and described, for obvious modifications will occur to a person of ordinary skill in the art.

What is claimed is:

1. A magnetically controlled switching matrix, comprising: a plurality of magnetic members arranged in rows and columns of said switching matrix, each member made from a magnetic material having at least two stable states of magnetization; a first coil of each of said magnetic members placed thereon which induces a magnetic flux in said member and is connected into the electric circuit of said matrix row associated with said magnetic member; a second coil of each of said magnetic members placed thereon which induces a magnetic flux in said member and is connected into the electric circuit of said matrix column associated with said magnetic member; each said magnetic member magnetically coupled with at least one respective magnetically responsive switch; a row selection circuit having an input and an output electrically connected with all of said first coils of said magnetic members; a column selection circuit having an input and output electrically connected with all of said second coils of said magnetic members; a generator of decaying alternating current pulses with its output connected with the input of said row selection circuit; and a direct current generator with the output thereof connected with the input of said column selection circuit.

2. A switching matrix as defined in claim 1, in which said first and said second coils are wound on said magnetic member so that the magnetic fluxes induced thereby are coaxial.

3. A switching matrix as defined in claim 1, in which said first and said second coils are wound on said magnetic member so that the magnetic fluxes induced thereby are orthogonal.

4. A switching matrix as defined in claim 2, which further contains closed loops placed on said magnetically responsive switches and made from a non-magnetic material exhibiting electric conductance sufficient to protect said magnetically responsive switches from the effect of a decaying alternating magnetic field.

5. A switching matrix as defined in claim 4, which, in the event each magnetic member is magnetically coupled with one magnetically responsive switch, includes a closed loop placed on this switch.

6. A switching matrix as defined in claim 4, which, in the event each magnetic member is magnetically coupled with at least two magnetically responsive switches, includes a closed loop placed on these switches.

7. A switching matrix as defined in claim 1, in which the magnetically responsive switches are disposed so that the magnetic axes of all the magnetically responsive switches run parallel with the matrix columns.

* * * * *